United States Patent [19]

Wlodek

[11] 4,022,587

[45] May 10, 1977

[54] PROTECTIVE NICKEL BASE ALLOY COATINGS

[75] Inventor: Stanley T. Wlodek, Indianapolis, Ind.

[73] Assignee: Cabot Corporation, Kokomo, Ind.

[22] Filed: Sept. 8, 1975

[21] Appl. No.: 611,201

Related U.S. Application Data

[63] Continuation-in-part of Ser. No. 463,659, April 24, 1974, abandoned.

[52] U.S. Cl. ..... 75/171; 428/656; 428/678

[51] Int. Cl.[2] ..... B32B 15/00

[58] Field of Search ..... 29/194; 75/171

[56] References Cited

UNITED STATES PATENTS

| | | | |
|---|---|---|---|
| 3,649,225 | 3/1972 | Simmons | 29/194 |
| 3,676,085 | 7/1972 | Evans et al. | 29/194 |
| 3,741,791 | 6/1973 | Maxwell et al. | 29/194 X |
| 3,754,903 | 8/1973 | Goward et al. | 75/171 |
| 3,846,159 | 11/1974 | Bernstein et al. | 75/171 X |

*Primary Examiner*—L. Dewayne Rutledge
*Assistant Examiner*—E. L. Weise
*Attorney, Agent, or Firm*—Eugene F. Buell; Jack Schuman; Joseph J. Phillips

[57] ABSTRACT

Nickel and cobalt base alloy articles are provided coated with a composition consisting essentially of about 20–60% chromium, 6–11% aluminum, 0.01–2.0% of a reactive metal such as yttrium, lanthanum or cerium and the balance nickel.

5 Claims, No Drawings

PROTECTIVE NICKEL BASE ALLOY COATINGS

This application is a continuation-in-part of my copending application Ser. No. 463,659 filed Apr. 24, 1974, now abandoned.

This invention relates to protective nickel base coatings and particularly to the composition of a nickel-base alloy coating, particularly suitable to the protection of nickel- and cobalt-base alloys, intended for service in highly oxidizing and corrosive, high temperature environments as encountered in industrial and flying gas turbines.

Those components of gas turbines such as blades, vanes and combustion cans, which are exposed to the highest operating temperatures of the turbine, often are constructed from high strength nickel- and cobalt-base alloys which do not possess sufficient environmental resistance to operate at their optimum strength capabilities. It is normal practice to coat such components with alloys which are more oxidation and corrosion resistant alloys, thus allowing higher operating temperatures, higher thrust efficiency, and longer periods between engine overhaul. A continued improvement in the environmental resistance of such coatings is therefore necessary in order to provide continued improvements in the cost effectiveness and performance of gas turbine systems. The most advanced and effective coatings that have been developed for such applications are cobalt- or nickel-base alloys containing chromium, aluminum, and yttrium as the predominant alloying elements. Coatings of this type are usually deposited on the article to be protected by vacuum deposition techniques or other similar transfer processes. Typical examples of the more advanced coatings of this type are the Co-Cr-Al-Y compositions described by Evans and Elam in U.S. Pat. No. 3,676,085 and the Ni-Cr-Al-Y compositions described in U.S. Pat. No. 3,754,903 by Goward, Boone and Pettit.

In comparison with the current state of the art, the coating alloy composition described in this patent offers an improvement in elevated temperature capability in a system which is softer and more ductile than currently used coatings.

In addition to excellent resistance to oxidizing and corrosive environments, the coatings that are used on critical components in gas turbines must not detract from the mechanical properties of such critical components as turbine blades, vanes and combustion cans. In particular, the coating must be soft enough, even at ambient temperatures, so as not to provide a preferential point for crack nucleation in high stress applications. Otherwise, the coating, although protective in the environment, can reduce the mechancial properties of the coated ensemble. In addition, it must be understood that gas turbines, particularly those used in aircraft, operate in a cyclic manner, with constant variations in the temperature to which the turbine components are exposed. The coating, therefore, must be of such a type that it is compatible with and able to withstand rapid thermal cycles.

The present invention provides a nickel-base alloy coating composition consisting of predominantly about 20–60% chromium, about 6–11% aluminum and about 0.01–2.0% yttrium and/or other rare earth elements, which are both oxidation and corrosion resistant and have uniquely desirable mechanical properties to avoid crack nucleation and withstand rapid thermal cycling.

This coating composition has been found to be suitable for deposition by vacuum evaporation techniques and could conceivably also be applied by other processes including: electrophoresis and sputtering techniques. The above coating composition is protective to nickel and cobalt superalloys and offers the advantages of high environmental resistance in high velocity oxidizing environments both in the absence and presence of such corrosive species as chlorides and sulfur. In addition, the coating compositions identified in this invention are soft enough so as to not appreciably reduce the high temperature and ambient temperature properties of the high strength nickel- and cobalt-base superalloy components which they are intended to protect.

This invention can perhaps best be understood by the following examples, illustrating the practice and composition which I have found best suited to accomplish the purposes above described.

In order to demonstrate that the preferred composition covered by this invention is applicable to both nickel-and cobalt-base superalloys, the examples used in the following description of this invention refer to data obtained on both Inconel alloy 713LC, a high strength nickel-base superalloy which enjoys probably the highest volume of application in gas turbines, and MAR-M-509, a cobalt-base alloy frequently used for vanes in advanced gas turbines. The compositions of these two commercial superalloys are:

Inconel alloy 713LC — Nickel base, 12.5% Cr, 4.2% Mo, 2.0% Cb, 0.8% Ti, 6.1% Al, 0.012% B, 0.010% Zr, 0.12% C — all in terms of weight percent. The low chromium level of this composition is responsible for its particularly poor hot corrosion and oxidation resistance at elevated temperatures and compositions of this type nearly always require coating in gas turbine service.

MAR-M-509 — Cobalt-base, 21.5% Cr, 10% Ni, 7% W, 0.2% TI, 0.010% B, 0.50% Zr, 1.0% Fe, 3.5% Ta, 0.60% C — all in terms of weight percent. This higher chromium content cobalt-base alloy has good hot corrosion resistance but will oxidize quite rapidly at elevated temperature.

In order to permit direct comparison with the most advanced coatings currently available, the preferred nickel-chromium-aluminum-yttrium compositions of this invention were compared in all tests made to the cobalt-chromium-aluminum-yttrium compositions described in U.S. Pat. No. 3,676,085 and the nickel-chromium-aluminum-yttrium compositions described in U.S. Pat. No. 3,754,903. To assure that all comparisons made between the properties of the preferred coating composition and the currently available coatings, the method of deposition utilized in our studies was inherently the same as that described in U.S. Pat. No. 3,676,085, while the testing conditions that were used to define the degree of improvement available in the preferred compositions of this invention were, in general, more severe than those utilized in U.S. Pat. No. 3,754,903.

TABLE I

COATING ALLOYS USED
Nominal Composition, w/o

| Alloy | Co | Ni | Al | Cr | Y |
|---|---|---|---|---|---|
| A | 70.35 | — | 11.5 | 17.5 | 0.65 |
| B | — | 49.8 | 10.5 | 38.2 | 1.1 |

TABLE I-continued

| COATING ALLOYS USED Nominal Composition, w/o | | | | | |
|---|---|---|---|---|---|
| Alloy | Co | Ni | Al | Cr | Y |
| C | — | 61.1 | 21.4 | 15.2 | 1.62 |

Table I gives the nominal chemical analysis of the alloys which were used in this study. Alloy A is the Co-Cr-Al-Y type of composition of U.S. Pat. No. 3,676,085, Alloy B is the composition which was used to generate the preferred coatings described here, and Alloy C is the comparison composition of the nickel-chromium-aluminum-yttrium type described in U.S. Pat. No. 3,754,903.

The compositions in Table I were prepared by vacuum induction melting and cast into 2-inch diameter bar. The above coating bar was used to feed a standard vacuum deposition coating system in which the presence of a high vacuum ($10^{-4}$ Torr or better) assured the evaporation of the above coating composition when the molten alloy is heated with electron beams to above its evaporation temperature. In order to generate variations in composition of the coatings deposited from Alloy B, variations in evaporation conditions were used. Analysis of the actual coatings were obtained on every fourth or fifth specimen by depositing the coating on a tab sample which was subjected to X-ray fluorescense chemical analysis. For test purposes, the above coatings were deposited on investment cast rods of MAR-M-509 and Inconel alloy 713LC, approximately 3 inches long and ¼ inch diameter. These rods were preheated in the vacuum system to about 1750° F and approximately 3 to 5 mils of the cooling alloy were deposited. After coating, the samples were heat treated in a vacuum of $10^{-5}$ Torr for four hours at a temperature of 1975° F and peened with glass beads at an air pressure in the range of 30 to 25 psi, similar to a technique described in U.S. Pat. No. 3,676,085.

EXAMPLE I

Duplicate samples of Inconel alloy 713LC were vacuum coated using the previously described procedure with coatings deposited from each of Alloys A, B, and C of the composition given in Table I. In order to determine the protectiveness of the coatings to ultra high temperature dynamic oxidation, all of the above samples were tested simultaneously, so as to assure direct comparison. During test, the samples were held in a holder rotating at 60 rpm, so as to assure uniformity of exposure to the combustion products obtained by the combustion of No. 2 fuel oil containing 0.4% sulfur. The temperature to which the samples were subjected was 2100° F, and the velocity of the combustion products was in excess of 200 miles per hour. In order to simulate the engine cycles which occur in gas turbines, the samples were withdrawn from the test system every 30 minutes and subjected to a blast of cold air which decreased their temperature, from 2100° F to below 600° F, in 2 minutes. After this cooling cycle, the samples were immediately reinserted in the path of the hot combusion product for another 30-minute period. This test was continued for 100 hours. Every 24 hours the samples were removed from test and examined for the first sign of coating failure. At the end of the 100 hour test period, the samples were sectioned for metallographic examination to identify the source of failure and if no failure had occurred the depth of attack, as exemplified by the depth of continuous and discontinuous oxide penetration into the coating was measured. These results are summarized in Table II which gives the actual X-ray fluorescent analysis of the deposited coating, summarizes the time to failure if any, and presents the depth of oxide attack that is continuous with the surface as well as the total depth of attack which is the sum of continuous and discontinuous oxide penetration, for those samples which did not fail during the test. The results indicate that, although the Co-Cr-Al-Y composition of U.S. Pat. No. 3,676,085 failed within 63 hours (Samples 1 and 2), as did the low aluminum composition deposited from Alloy B of this invention (Samples 5 and 6), the preferred composition of this invention, as exemplified by Samples 3 and 4, as well as the type of Ni-Cr-Al-Y coatings (Samples 7 and 8) described in U.S. Pat. No. 3,754,903 did not fail within the 100 hour period of the test.

TABLE II

HIGH TEMPERATURE OXIDATION BEHAVIOR OF COATINGS DEPOSITED ON ALLOY 713LC

| Sample | Coating Composition, w/o Co | Ni | Cr | Al | Y | Coating Thickness mils | Deposited From Alloy | Hrs. to Failure in 2100° F Dynamic Oxidation | Integrity of Coating: Depth of Continuous Oxide Penetration mils | Total Depth of Oxide Penetration mils |
|---|---|---|---|---|---|---|---|---|---|---|
| 1 | 73.0 | — | 16.0 | 11.3 | 0.6 | 4–5 | A | 63 | FAILURE | |
| 2 | 73.0 | — | 16.0 | 11.3 | 0.6 | 4–5 | A | 63 | FAILURE | |
| 3 | — | 50.3 | 34.6 | 10.3 | 1.1 | 4–5 | B | >100 | 0.63 ± 0.07 | 0.92 ± 0.15 |
| 4 | — | 51.8 | 33.0 | 10.7 | 1.3 | 4 | B | >100 | 0.9 ± 0.13 | 1.41 ± 0.28 |
| 5 | — | 39.6 | 56.8 | 709 | 0.2 | 3 | B | 63 | FAILURE | |
| 6 | — | 39.6 | 56.8 | 7.9 | 0.2 | 3 | B | 63 | FAILURE | |
| 7 | — | 59.2 | 17.1 | 17.1 | 1.0 | 4 | C | >100 | 0.97 ± 0.14 | 1.17 ± 0.2 |
| 8 | — | 59.2 | 17.1 | 19.3 | 0.4 | 3–4 | C | >100 | — | — |

Metallographic examination of samples 3, 4, 7 and 8 indicated, in general, that the preferred compositions deposited from Alloy B retained about the same level of unattacked coating as those deposited from Alloy C.

EXAMPLE II

Using the same testing procedure, as previously described in Example I, the behavior of coatings deposited from alloys A, B and C was evaluated when applied to the cobalt-base alloy, MAR-M-509. The results obtained are given in Table III. In this series of tests, none of the coatings failed within the 100 hour period. However, metallographic examination of the samples after test indicated that one of the samples (No. 9) with the Co-Cr-Al-Y coating of U.S. Pat. No. 3,676,085 was appreciably attacked, with approximately 3.55 ± 1.73 mils of the coating thickness penetrated by oxides. It should be noted that, although the original coating thickness was 4 to 5 mils, diffusion reactions during the heat treatment and test period exposure had appreciably increased the thickness of the coating. Similarly, coatings deposited from the Alloy C type bath of U.S. Pat. No. 3,754,903 were erratic in their behavior with Sample 14 consumed to the point that 2.65 ± 0.59 mils of the coating thickness were penetrated by continuous and discontinuous oxides.

In order to verify these results at a lower test temperature, an identical test was performed on MAR-M-509 samples, two coated with the preferred Ni-Cr-Al-Y composition of this invention, as deposited from Alloy B and two as deposited from Alloy C. Except that the maximum test temperature was 2000° F, all testing conditions were the same as described in Example I. The coatings deposited from bath B did not fail in 450 hours. Samples coated with the Alloy C composition failed in 256 hours, verifying the superior protectiveness of the Ni-Cr-Al-Y system described here, over that offered by U.S. Pat. No. 3,754,903, when applied to cobalt-base article.

EXAMPLE III

Gas turbines operating in marine, environment, including aircraft that may fly over salt water, are subjected to a particularly catastropic form of attack that is induced by the presence of sulfur in the fuel and the presence of sodium chloride or salt in the environment. This combination of salt and sulfur produces hot corrosion or very rapid catastrophic oxidation of most superalloys, particularly 713LC which, due to its low chromium content, a compositional characteristic common to many advanced nickel-base alloys, is usually susceptible to hot corrosion attack. In addition, this type of attack is maximized by relatively low temperatures, the maximum attack for alloy 713LC occurring at about 1650° F, and low gas velocities.

TABLE III

HIGH TEMPERATURE OXIDATION BEHAVIOR OF COATINGS DEPOSITED ON ALLOY MAR-M-509

| Sample | Coating Composition, w/o Co | Ni | Cr | Al | Y | Coating Thickness mils | Deposited From Alloy | Hrs. to Failure in 2100° F Dynamic Oxidation | Integrity of Coating: Depth of Continuous Oxide Penetration mils | Total Depth of Oxide Penetration mils |
|---|---|---|---|---|---|---|---|---|---|---|
| 9 | 72.8 | — | 12.9 | 11.0 | 0.7 | 4–5 | A | 100 | 0.68 ± 0.35 | 3.55 ± 1.73 |
| 10 | 73.0 | — | 15.9 | 11.3 | 0.6 | 4–5 | A | 100 | 0.81 ± 0.38 | 0.97 ± 0.27 |
| 11 | — | 51.8 | 33.0 | 10.7 | 1.3 | 4 | B | 100 | 1.09 ± 0.32 | 1.30 ± 0.37 |
| 12 | — | 39.6 | 56.8 | 8.0 | 0.2 | 3 | B | 100 | 0.32 ± 0.09 | 0.68 ± 0.24 |
| 13 | — | 39.6 | 58.8 | 8.0 | 0.2 | 3 | B | 100 | 0.34 ± 0.07 | 0.74 ± 0.13 |
| 14 | — | 59.2 | 17.1 | 17.1 | 1.0 | 4 | C | 100 | 1.1 ± 0.63 | 2.65 ± 0.59 |
| 15 | — | 63.0 | 10.7 | 17.2 | 1.0 | 3 | C | 100 | 0.62 ± 0.12 | 0.62 ± 0.12 |

In order to evaluate the effectiveness of advanced coating systems in resisting hot corrosion type of attack, coatings were deposited from Alloys A, B and C on the nickel-base alloy 713LC and subjected to hot corrosion testing at 1650° F, the temperature of approximately maximum attack in this type of corrosion. The conditions of test are believed to be more severe than those quoted in U.S. Pat. No. 3,754,903. In brief, all samples were simultaneously rotated at about 60 rpm in a holder, inserted in the path of the combustion products obtained from No. 2 fuel oil (0.4% sulfur) to which was added 5 ppm of standard synthetic sea salt on a weight basis per pound of air. The test was continued for 1000 hours with thermal cycling of the specimens being achieved every hour, by withdrawing the samples and cooling them in about two minutes to a temperature below 1000° F. In this test, the samples are exposed to relatively low gas velocities, approximately 1 to 10 mph. The samples were removed from test and examined approximately every 24 hours to 50 hours to determine the first sign of coating failure. As before, those samples which did not fail during the 1000 hour test period were subjected to metallographic examination so as to determine the amount of sound coating remaining.

The results of this series of experiments are summarized in Table IV. Coatings deposited from Alloy A showed no sign of failure during the test period. Coatings of the Ni-Cr-Al-Y type described in U.S. Pat. No. 3,754,903 failed after 320 hours, in excellent agreement with the 330 hour life documented for coatings of this type, in Example II of the above patent. Coatings deposited from the preferred Ni-Cr-Al-Y composition, as exemplified by samples 18 and 19, lasted for 827 and 575 hours before failure, an appreciable improvement over those coatings deposited from Alloy C.

TABLE IV

HOT CORROSION BEHAVIOR OF COATINGS DEPOSITED ON ALLOY 713LC

| Sample | Coating Composition, w/o Co | Ni | Cr | Al | Y | Coating Thickness mils | Deposited From Alloy | Hrs. to Failue in 1650° F Corrosion | Integrity of Coating: Depth of Continuous Oxide Penetration mils | Total Depth of Oxide Pentration mils |
|---|---|---|---|---|---|---|---|---|---|---|
| 16 | 73.0 | — | 16.0 | 11.3 | 0.6 | 4–5 | A | 1000 | 0.33 ± 0.15 | 0.33 ± 0.11 |
| 17 | 72.1 | — | 16.1 | 11.2 | 0.6 | 4–5 | A | 900 | — | — |
| 18 | — | 51.8 | 32.9 | 10.7 | 1.33 | 4 | B | 827 | FAILURE | |
| 19 | — | 51.8 | 32.9 | 10.7 | 1.33 | 4 | B | 575 | FAILURE | |
| 20 | — | 59.2 | 17.1 | 19.3 | 0.4 | 3–4 | C | 320 | FAILURE | |
| 21 | — | 59.2 | 17.1 | 19.3 | 0.4 | 3–4 | C | 320 | FAILURE | |

EXAMPLE IV

A truly effective coating system must not only protect the coated article from environmental attack over a wide range of temperatures and atmospheric compositions, but must do so without reducing the mechanical properties of the coated ensemble. In general, coatings that are applied to gas turbine components, such as blades and vanes, are inherently hard and brittle and thus tend to initiate cracks at the surface, promoting failure and reducing the capability of the resulting coated part to operate at maximum stress levels. In order to evaluate the compatibility of the coatings of this invention, pins of 713LC and MAR-M-509 were coated by vacuum evaporation from coating baths of composition A, B and C, as previously described. After coating, the samples were heat-treated in air for 1000 hours at 1600° F, in order to develop any embrittling phases and structures that are promoted by long time temperature exposure, particularly in the 1600° F range where the ratio of formation of such deleterious structures is often a maximum. After the above heat treatment, metallographic samples were taken across the coating-base metal system and microhardness measurements made in the coating, to determine its hardness, and indicate its brittleness.

TABLE V

HARDNESS OF COATINGS AFTER 1000 HOUR/1600° F EXPOSURE

| Sample | Coating Composition, w/o | | | | | Coating Thickness mils | Deposited From Alloy | Base Alloy | Diamond Pyramid Hardness of Coating at | | |
|---|---|---|---|---|---|---|---|---|---|---|---|
| | Co | Ni | Cr | Al | Y | | | | Top | Center | Bottom |
| 22 | 72.8 | — | 12.9 | 11.0 | 0.7 | 4–5 | A | 713LC | 425 | — | 417 |
| 23 | 72.8 | — | 12.9 | 11.0 | 0.7 | 4–5 | A | MAR-M-509 | 498 | 450 | 478 |
| 24 | — | 50.3 | 34.6 | 10.4 | 1.1 | 4–5 | B | 713LC | 336 | 354 | 366 |
| 25 | — | 49.9 | 36.6 | 10.8 | 0.4 | 4–5 | B | MAR-M-509 | 325 | 330 | 380 |
| 26 | — | 59.2 | 17.1 | 19.3 | 0.4 | 3–4 | C | 713LC | 459 | 468 | 442 |
| 27 | — | 59.2 | 17.1 | 19.3 | 0.4 | 3–4 | C | MAR-M-509 | 434 | 354 | 319 |

The results of such microhardness traverse are summarized in Table V in terms of the diamond pyramid hardness, as determined by impressing a standard diamond indentor with a 100 gram load into the top, center and bottom positions within the coating. In all cases, it is possible to conclude that regardless of the nature of the base the preferred Ni-Cr-Al-Y coating composition, which is the subject of this invention (samples 24 and 25) is softer than the coatings deposited on either 713LC or MAR-M-509 from compositions of the type described in U.S. Pat. Nos. 3,676,085 (samples 22 and 23) and 3,754,903 (samples 26 and 27).

This invention, as the examples demonstrate, provides soft coatings, and effectively protects high temperature nickel- and cobalt-base alloys, from oxidation and hot corrosion attack, over the whole temperature range of interest. In its broadest terms this invention provides a coating consisting essentially by weight of 20–60% chromium, 6–11% aluminum and 0.01–2.0% of a reactive metal such as yttrium, lanthanum, or cerium, the balance being essentially nickel. I have found that in order to obtain the desired soft coatings and the combinations of oxidation resistance and resistance to hot corrosion attacks over the range of temperatures here of interest I must maintain the aluminum content lower than that taught by the prior art and in fact in the very range which has heretofore been considered unworkable. A narrower preferred range of composition is by weight about 20 to 40% chromium, about 8 to 11% aluminum, about 0.01 to 2.0% reactive metal from the group yttrium, lanthanum or cerium, and the balance essentially nickel. The specific preferred composition is that shown in Table I, Alloy B.

In the foregoing specification, I have set out certain preferred practices and embodiments of this invention. It will be understood, however, that this invention may be otherwise practiced within the scope of the following claims.

I claim:

1. An article of a nickel or cobalt base alloy bonded directly to a coating having a composition consisting essentially of about 20–60% Cr, 6–11% Al, 0.01–2.0% of a reactive metal selected from the group consisting of yttrium, lanthanum and cerium and the balance essentially Ni and characterized by resistance to oxidation and corrosion at elevated temperatures and resistance to crack nucleation at high stress.

2. An article as claimed in claim 1 wherein the coating consists essentially of 20–40% Cr, 8–11% Al, 0.01–2.0% reactive metal and the balance Ni.

3. An article as claimed in claim 1 wherein the coating consists essentially of about 17.5% Cr, about 10.5% Al, about 1.1% yttrium and the balance nickel.

4. An article as claimed in claim 1 wherein the reactive metal is yttrium.

5. A coating composition for protecting nickel and cobalt base articles consisting essentially of 20–60% Cr, 6–11% Al, 0.01–2.0% of a reactive metal selected from the group consisting of yttrium, lanthanum and cerium and the balance essentially Ni.

* * * * *

UNITED STATES PATENT OFFICE

CERTIFICATE OF CORRECTION

Patent No. 4,022,587 Dated May 10, 1977

Inventor(s) STANLEY T. WLODEK

It is certified that error appears in the above-identified patent and that said Letters Patent are hereby corrected as shown below:

Table II, under the heading Coating Composition, w/o, Al coating (Sample 5), "709" should read --7.9--.

Column 5, under the heading EXAMPLE III, line 23, after "marine" delete the comma.

Column 5, line 25, "catastropic" should read --catastrophic--.

Column 7, line 12, "ratio" should read --rate--.

Column 7, line 29, "traverse" should read --traverses--.

Signed and Sealed this nineteenth Day of July 1977

[SEAL]

Attest:

RUTH C. MASON
Attesting Officer

C. MARSHALL DANN
Commissioner of Patents and Trademarks